US005397255A

United States Patent [19]

Heer

[11] Patent Number: 5,397,255

[45] Date of Patent: Mar. 14, 1995

[54] BOAT PROPULSION UNIT WITH A PROPULSION PROPELLER ARRANGED UNDER THE BOAT'S BOTTOM

[75] Inventor: Manfred Heer, Spay am Rhein, Germany

[73] Assignee: Schottel-Werft Josef Becker GmbH & Co., KG, Germany

[21] Appl. No.: 202,966

[22] Filed: Feb. 28, 1994

[30] Foreign Application Priority Data

Mar. 1, 1993 [DE] Germany ..... 43 06 323.3

[51] Int. Cl.[6] ..... B63H 5/12

[52] U.S. Cl. ..... 440/54

[58] Field of Search ..... 49/477; 440/54, 53; 114/150, 151, 320–324, 335, 337, 338, 183 R, 125

[56] References Cited

U.S. PATENT DOCUMENTS

| | | | |
|---|---|---|---|
| 2,699,138 | 1/1955 | Dyer | 440/54 |
| 2,885,990 | 5/1959 | Hawthorne | 440/54 |
| 3,030,910 | 4/1962 | Alsager | 440/54 |
| 3,045,622 | 7/1962 | Kittredge | 114/325 |
| 3,678,872 | 7/1972 | Migliaccio et al. | 114/323 |
| 3,941,073 | 3/1976 | Ridgeway | 114/183 R |
| 4,441,278 | 4/1984 | Covey, III | 49/477.1 |

*Primary Examiner*—Edwin L. Swinehart
*Attorney, Agent, or Firm*—Levine & Mandelbaum

[57] ABSTRACT

A boat propulsion unit has a propeller which can be withdrawn into a sleeve to a position above the plane of the boat's bottom and enclosed by a cover plate. The water in the closed sleeve can be pumped out, so that the emptied sleeve is accessible for inspection and maintenance operations.

14 Claims, 3 Drawing Sheets

BOAT PROPULSION UNIT WITH A PROPULSION PROPELLER ARRANGED UNDER THE BOAT'S BOTTOM

BACKGROUND OF THE INVENTION

The present invention is based on a boat propulsion unit of the type having a propulsion propeller, which is arranged under the boat's bottom, which is preferably essentially flat, at least in the area of the propulsion unit, and which can be withdrawn into a sleeve to a position above the plane of the boat's bottom.

More specifically, the present invention is based on a boat propulsion unit which includes a rudder propeller. Such propulsion units are associated, in general, with watercraft which are intended for traveling in shallow waters. Such watercraft have a bottom, at least parts of which are flat, and a vertical propeller steering shaft which connects the engine in the interior of the boat to the propeller under the boat's bottom and outside the watercraft, and passes through the bottom, while being sealed against water. The propeller causes propulsion of the watercraft by rotation around its horizontal axis. Being a rudder propeller, it is not only rotatable around its horizontal axis, but it is also pivotable around the longitudinal axis of the propeller steering shaft in order to change or otherwise determine the direction of travel of the watercraft.

The possibility of traveling in shallow waters is limited when the propeller is located under the boat's bottom. Therefore, the propeller can be withdrawn for such cases into a sleeve integrated within the boat's contour. When the watercraft reaches correspondingly shallow waters, the propeller is pulled up into the sleeve to the extent that it comes to lie above the plane of the boat's bottom. Even though the watercraft can no longer be steered by means of the retracted propeller, it nevertheless can still travel, via other means, in an area through which it could not otherwise navigate because of the depth of water being excessively low.

The problem thus far described, is one pertaining to navigation. The watercraft should be able to enter very shallow waters and be moved therealong temporarily, e.g., for being loaded or unloaded at the shortest possible distance from the shore.

The present invention deals with another aspect of the problem. It is directed to modification of such a watercraft, whose propulsion system is designed according to the foregoing requirements, such that repairs can be carried out on the underwater part of the propulsion system at the lowest possible expense. In prior-art watercraft, repair on the outboard part of the propulsion system has always made it necessary to bring the watercraft on land or into a dock. This was the prerequisite for a repair unless one wished to remove the entire propulsion system, which involved considerable expense.

SUMMARY OF THE INVENTION

The foregoing problem is overcome by the present invention to the extent that a considerable percentage of repairs, especially minor ones, can be performed without the need to bring the watercraft on land or into a dock or to remove the propulsion system, while the watercraft remains in the water. The present invention makes this possible by isolating the assembled steering shaft and propeller when retracted into the sleeve, from the water surrounding the watercraft, by pumping the water out of the sleeve, and by making the chamber, which has thus been rendered free of water, accessible to maintenance personnel.

The present invention is first defined rather generally with respect to the task, and then increasingly more specifically, in the patent claims. As broadly defined, the present invention can accomplish the foregoing task in its entirety. It further solves several problems, including the accommodation of the propeller in its inactive disposition.

The present invention will be explained in greater detail below on the basis of the drawings.

DESCRIPTION OF THE PREFERRED EMBODIMENT

Figure 1:
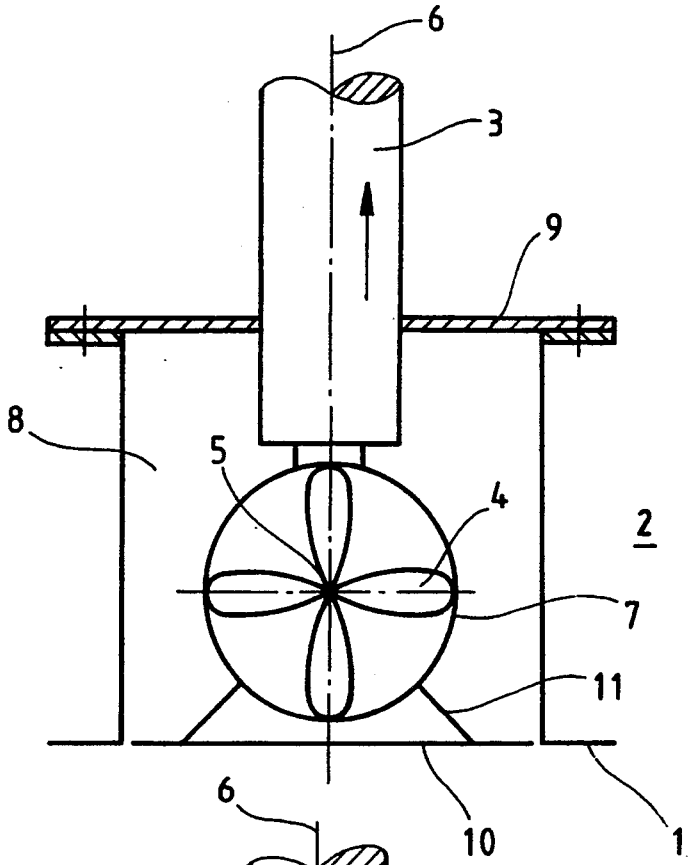
FIG. 1 is a schematic elevation end view of the apparatus of the invention showing the propeller, which can be withdrawn into a sleeve, in its retracted position.

The energy generation part, i.e., the engine, transmission, etc., is arranged in the interior 2 of the watercraft enclosed by the outer skin, and since it may be of any appropriate type known to those skilled in the art, it is not shown. A vertical propeller shaft 3 leads from the energy generation part inboard to the propeller 4 arranged outboard, which is rotatable around its horizontal axis of rotation 5 in order to bring about the propulsion of the watercraft. The propeller steering shaft 3 with its vertical longitudinal axis 6 and the propeller drive shaft 5 with its horizontal axis of rotation are connected to one another in known manner via an angular gear (not shown). The propeller 4 is a rudder propeller, and the direction of propulsion of the watercraft is determined by means of the propeller 4, which is pivotable by up to 360° around the longitudinal axis 6 of the propeller steering shaft 3, as is known in the art. Hence no further means for accomplishing the steering are shown.

The rudder propeller 4 is surrounded by a nozzle 7. A sleeve 8, which is a rotationally symmetrical cylinder, is arranged in the support structure of the watercraft concentrically to the longitudinal axis 6 of the propeller steering shaft 3. The rudder propeller 4 is vertically movable, with the nozzle 7 surrounding it, within the sleeve 8. To achieve this, the propeller steering shaft 3 is of variable length or is longitudinally adjustable. In one end position, the rudder propeller 4 with the nozzle 7 is completely within the sleeve 8 behind the plane which is defined by the flat, even bottom of the outer skin 1 of the boat. The rudder propeller is shown in its retracted (inactive) position in FIG. 1. In its extended position, the rudder propeller 4 with the nozzle 7 is located under the plane defined by the flat, even bottom of the outer skin 1 of the watercraft. In this position, shown in FIG. 2, the rudder propeller is in its active operating position, in which the magnitude and direction of propulsion of the watercraft can be controlled.

The sleeve 8 is enclosed in a water-tight manner at the top end by a cover 9, and the propeller steering shaft 3 is led through the cover 9 in a water-tight manner. In this respect, this is a conventional unit.

According to the present invention, a rigid, even plate 10 is fastened to the rudder propeller 4 at the nozzle 7 by means of a frame 11 in the lower nozzle area. The plate 10 is associated with the nozzle 7 such that it is located in the aforementioned bottom plane, which is defined by the flat bottom of the outer skin 1 of the watercraft when the rudder propeller 4 is located in its out-of-use position, i.e., when it has been retracted into the sleeve 8 according to FIG. 1. In this embodiment, the lower cover of the sleeve 8, which cover is formed by the plate 10, protects the rudder propeller from being damaged in the extended position by coarse deposits, a risk which is present when the watercraft is located in shallow water.

Since, even in shallow water, the watercraft is able to move at a speed sufficient to generate flow formation in the annular gap between the cover 10 and the lower edge of the sleeve 8, which can be problematical, the annular gap is kept especially small.

The gap is closable in an embodiment of the present invention. To achieve this, a circumferential, strand-like sealing profiled section 12 is arranged at the lower edge of the wall of the sleeve 8. The profiled section 12 is a hollow profile consisting of an elastic material and has variable internal pressure which can be determined with a pump 13 and a reservoir 14 for a hydraulic or pneumatic pressurizing device outside the sleeve 8, but inboard, such that optimal, i.e., complete, sealing action is provided when the cover 10 is located exactly in the plane of the bottom of the outer skin of the watercraft (FIGS. 1 and 3) and is in contact with the seal 12, compressing it appropriately. This ensures closure of the sleeve 8 against flow action from the surrounding water, with the propeller 4 located behind the lower sleeve cover or plate 10.

When this state is reached, the draining and ventilation system can be activated according to an embodiment of the present invention. This embodiment has, on the one hand, a feed pump 15, with which the water in the sleeve 8 enclosed by the lower cover 10 can be removed. The water is pumped out of the sleeve 8 to the outside, into the water surrounding the watercraft. Air flows into the sleeve 8 through a one-way valve 16 to the extent water is pumped out of the sleeve 8. A liquid level switch 17, which signals the complete emptying of the water from the sleeve 8, and, when emptying is complete, switches off the pump 15, is located in the area of the lower end of the sleeve 8.

A manhole 18, which is normally covered by a manhole cover 19, is located in the upper sleeve cover 9. When the water has been completely pumped out of the closed sleeve 8, personnel can enter the drained sleeve 8 for repair and inspection operations on the underwater part of the propulsion system by removing the manhole cover 19.

Figure 2:
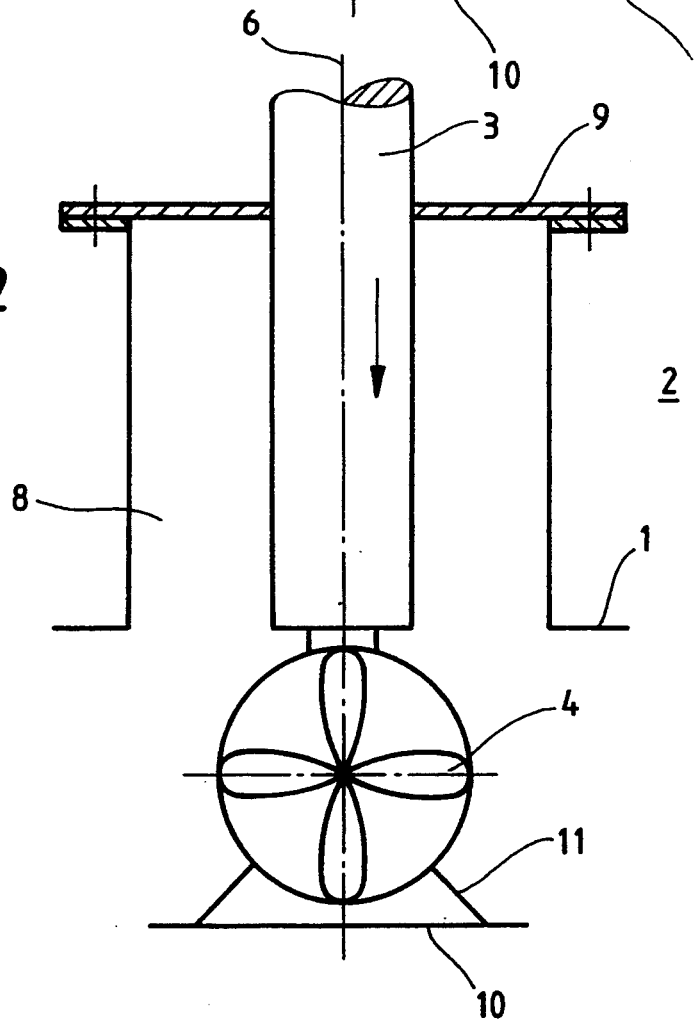
FIG. 2 is a schematic elevation end view of the apparatus of the invention showing the propeller, in its extended position.

In a corresponding manner, which need not be described in detail, the sleeve 8 can again be filled with water for putting the propulsion system into operation, and the propeller can be lowered through the sleeve 8 and extended from the sleeve 8 in order to cause it to reach the operating position according to FIG. 2. The filling of the sleeve 8 with water can be accomplished with the reversible pump 15 before the propeller is extended. However, it is also possible to use a nonreversible suction pump, in which case the sleeve 8 is refilled simply by opening the lower end of the sleeve 8 by lowering the lower sleeve cover 10 with the propeller 4 and its nozzle 7.

The sleeve 8 and the parts associated with it, i.e., especially the lower cover or plate 10, may be, in principle, of any desired design, without departing from the present invention. It may be a "well" or a "container," as is usually used in the relevant technical area.

It should be noted that the profiled section 12 is preferably arranged in an annular groove 20, which surrounds the lower edge of the sleeve 8 and is recessed in relation to the surrounding bottom of the outer skin 1 to the extent that the lower sleeve cover 10 can lie in the plane of the bottom in the case of optimal sealing action and is displaced from the sleeve wall to the extent that the profiled section 12 never projects into the sleeve past the sleeve wall.

Figure 3:
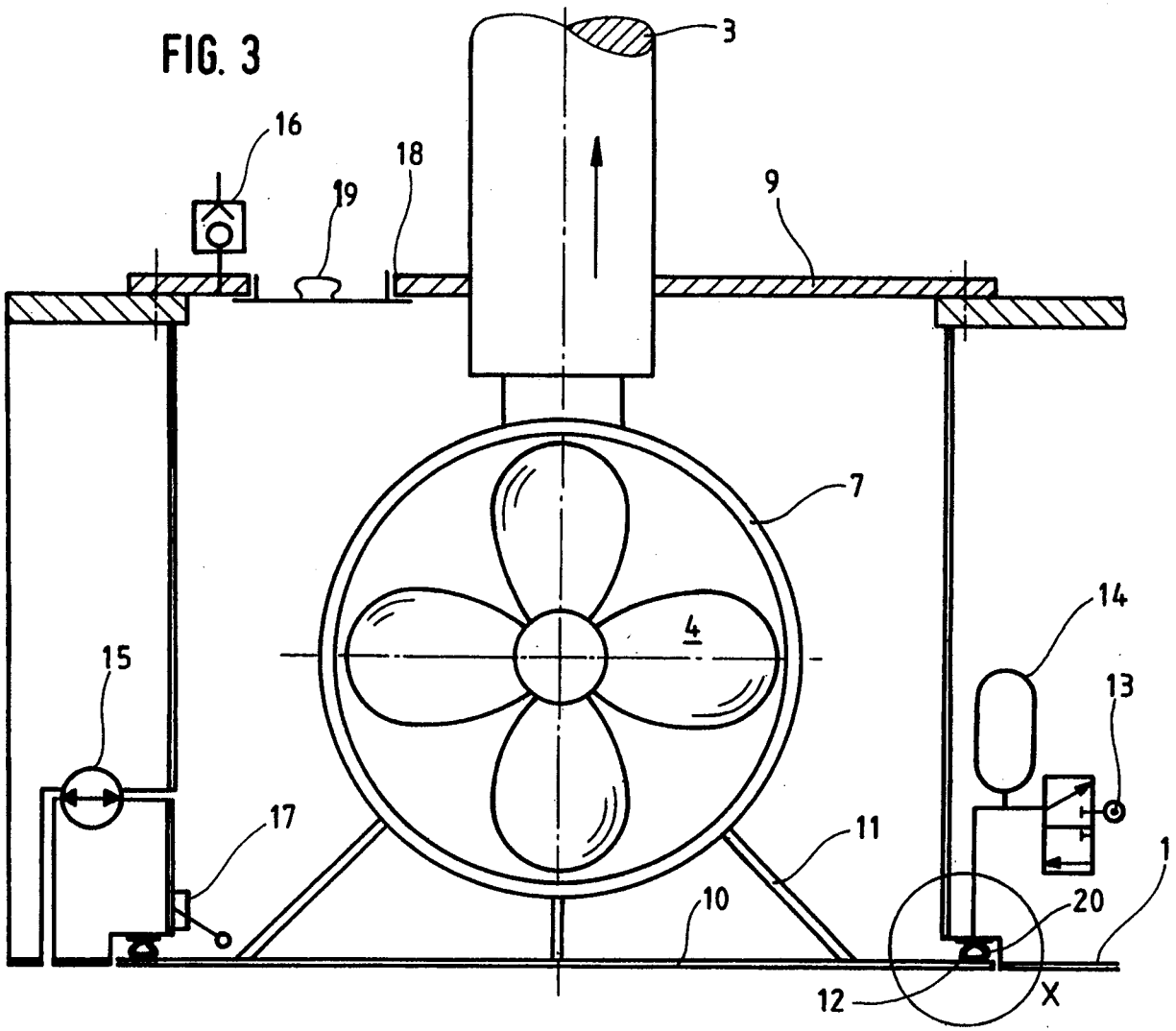
FIG. 3 is an enlarged schematic elevation end view of the apparatus of the invention in the propeller position according to FIG. 1 with further elements shown.
Figure 4:
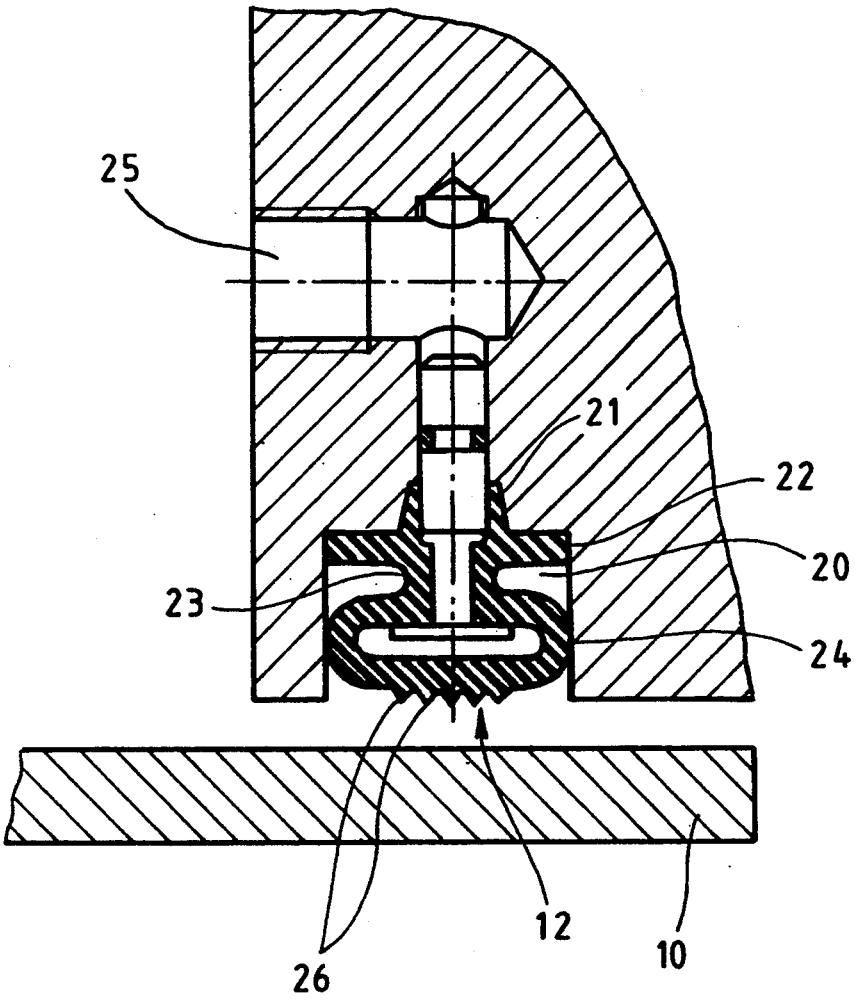
FIG. 4 is a fragmentary sectional view of the portion of the apparatus of the invention denoted X in FIG. 3, on an enlarged scale.

A possible design of the sealing profiled section 12 so as to form an annular hose which is closed on itself, and the annular groove 20 to accommodate the profiled section 12, as shown in the area indicated by X in FIG. 3, according to FIG. 4, will now be discussed. The annular groove 20 forms a channel of U-shaped cross section, which is open toward the plate 10, and in which the profile 12 is held over its entire circumference by a strip 21 under pretension. Fixation in the axial direction of the hose is ensured by a bearing plate 22 with which the profile is supported in the bottom of the channel. The bearing plate 22 is located between the holding strip 21 and a clip collar 23 which leads to the actual hose part 24.

In view of the requirements expected to be imposed on the operating speed, it is sufficient to connect the interior of the hose part 24, along its entire circumference, to the pump 13 or the reservoir 14 for hydraulic or pneumatic pressurizing through the clip collar 23, the bearing plate 22, and the holding strip 21. A plurality of perforations of the sealing profiled section may also be distributed along the entire circumference, and they can be connected to a collection channel 25 before connection to the feed means 13, 14. The surface of the profile facing the plate 10 has a plurality of annular sealing lips 26 located one behind the other in the radial direction.

What is claimed is:

1. In a boat propulsion device having a propeller mounted under the bottom of the boat, and a sleeve into which said propeller is retractable beyond the plane of said bottom, said bottom being essentially flat in the area of the propulsion device, the improvement wherein said sleeve is surrounded at its lower edge by an annular groove, said propulsion device comprising a sealing means disposed in said groove for sealing said sleeve when said sealing means is coplanar with the bottom of the boat, and said propulsion device comprises means for enclosing said sleeve when the propulsion device is withdrawn into it, said enclosing means comprising a plate acting as a cover in the plane of the bottom of said boat, the plate being mounted on the propulsion device in fixed disposition with respect to the axis of rotation of the propeller so that the plate and the propeller can be vertically raised and lowered together, the propeller being rotatable relative to the plate, and further comprising pump means for emptying the sleeve of water after the plate encloses the sleeve.

2. A boat propulsion device in accordance with claim 1, wherein said propulsion device further comprises a nozzle surrounding the propeller, said plate being connected to said nozzle.

3. A boat propulsion unit in accordance with claim 1 wherein the sealing means comprises an inflatable, annular hose.

4. A boat propulsion device in accordance with claim 3, further comprising means for inflating said sealing means with a hydraulic or pneumatic fluid, and for ventilating said sealing means when not in use.

5. A boat propulsion device in accordance with claim 1 further comprising pump means for emptying the sleeve of water after the plate encloses the sleeve.

6. A boat propulsion device in accordance with claim 5, further comprising a fixed cover mounted on the end of the sleeve opposite the end enclosable by the plate, said fixed cover having a manhole and means for enclosing and exposing said manhole.

7. A boat propulsion device in accordance with claim 6, further comprising valve means for admitting air to the interior of the sleeve when closed by the plate, the volume of air admitted corresponding to the volume of water pumped out of the sleeve.

8. A boat propulsion device in accordance with claim 7, further comprising sensor means for signaling when the sleeve has been emptied of water, said pump means being responsive to said sensor means.

9. A boat propulsion device in accordance with claim 8, wherein said sealing means comprises a hose enclosed on itself, said hose having a hollow chamber profile.

10. A boat propulsion device in accordance with claim 9, wherein said sleeve has a wall with a groove and further comprising strip means for holding said hose in said groove under tension.

11. A boat propulsion device in accordance with claim 10, further comprising bearing plate means in contact with the bottom of the annular groove for axially fixing the hollow hose in place.

12. A boat propulsion device in accordance with claim 10, further comprising clip collar means, said bearing plate means being disposed between said strip means, and said clip collar means, said bearing plate means, and clip collar means surrounding at least one fluid connection between the interior of the hose and said pump means.

13. A boat propulsion device in accordance with claim 12, further comprising a plurality of fluid connection means connected to said hose, and further comprising collection channel means operatively connected between each of said plurality of fluid connection means on one end thereof and to said pump means on the other end thereof.

14. A boat propulsion device in accordance with claim 13, further comprising a plurality of annular sealing lips radially spaced on the exterior of said sealing means.

* * * * *